US008146546B2

(12) United States Patent
Yuasa et al.

(10) Patent No.: US 8,146,546 B2
(45) Date of Patent: Apr. 3, 2012

(54) TWO-CYCLE ENGINE CYLINDER AND METHOD FOR MANUFACTURING THE SAME

(75) Inventors: Tsuneyoshi Yuasa, Kobe (JP); Masanori Kobayashi, Tokorozawa (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 905 days.

(21) Appl. No.: 12/215,328

(22) Filed: Jun. 26, 2008

(65) Prior Publication Data

US 2009/0013982 A1 Jan. 15, 2009

(30) Foreign Application Priority Data

Jun. 28, 2007 (JP) ..... 2007-170276

(51) Int. Cl.
*F02B 25/00* (2006.01)

(52) U.S. Cl. ..... 123/65 R; 123/65 P; 123/73 PP; 123/73 A

(58) Field of Classification Search ..... 123/65 R, 123/65 P, 73 PP, 73 A; 29/888.06, 888.061
See application file for complete search history.

(56) References Cited

U.S. PATENT DOCUMENTS

| | | | | |
|---|---|---|---|---|
| 1,328,276 | A * | 1/1920 | Fuchs | 29/888.06 |
| 3,513,465 | A * | 5/1970 | Titherington | 381/58 |
| 3,752,129 | A * | 8/1973 | Kobayashi et al. | 123/73 A |
| 3,759,625 | A * | 9/1973 | Iversen | 408/188 |
| 3,805,750 | A * | 4/1974 | Tenney | 123/73 R |
| 4,185,596 | A * | 1/1980 | Noguchi et al. | 123/51 B |
| 5,086,734 | A | 2/1992 | Nakai | |
| 5,471,960 | A * | 12/1995 | Nagao et al. | 123/65 A |
| 5,740,767 | A * | 4/1998 | Kaku et al. | 123/65 W |
| 5,992,358 | A | 11/1999 | Otome | |
| 6,041,499 | A * | 3/2000 | Matsuura et al. | 29/888.06 |
| 6,289,856 | B1 * | 9/2001 | Noguchi | 123/73 PP |
| 6,318,311 | B1 * | 11/2001 | Kikuchi | 123/73 PP |
| 6,513,465 | B2 * | 2/2003 | Fukuoka et al. | 123/73 PP |
| 6,928,729 | B2 * | 8/2005 | Britt et al. | 29/888.06 |
| 7,004,692 | B2 * | 2/2006 | Hecht | 408/233 |
| 7,159,314 | B2 * | 1/2007 | Brockel et al. | 29/888.06 |
| 7,243,622 | B2 * | 7/2007 | Tsutsui et al. | 123/73 PP |
| 7,458,153 | B2 * | 12/2008 | Uhl et al. | 29/888.06 |
| 2004/0107571 | A1 | 6/2004 | Leiendecker | |
| 2005/0166396 | A1 | 8/2005 | Brockel et al. | |
| 2006/0272600 | A1 * | 12/2006 | Tsutsui et al. | 123/73 PP |

FOREIGN PATENT DOCUMENTS

JP 58-155114 9/1983

(Continued)

OTHER PUBLICATIONS

Japanese Application No. 2007-170276 Notification of Reason(s) for Rejection, May 17, 2011, 7 pages with partial English translation.

(Continued)

*Primary Examiner* — Noah Kamen
*Assistant Examiner* — Long T Tran

(57) ABSTRACT

A cylinder block for the two-cycle combustion engine includes a scavenging port open at an inner peripheral surface of the cylinder block so as to orient diagonally upwardly relative to a longitudinal axis of a cylinder bore and defined in the cylinder block in communication with a combustion chamber. This scavenging port is formed by cutting with the rotary cutting tool, then rotated about its own longitudinal axis, from an inner peripheral surface of the cylinder block.

4 Claims, 15 Drawing Sheets

FOREIGN PATENT DOCUMENTS

| | | |
|---|---|---|
| JP | 03-085354 | 4/1991 |
| JP | 4-32222 | 3/1992 |
| JP | 10-266860 | 10/1998 |
| JP | 2004-106182 | 4/2004 |
| JP | 2004-181625 | 7/2004 |

OTHER PUBLICATIONS

Japanese Application No. 2007-170276 Office Action dated Jan. 24, 2012, 8 pages with partial English translation.

* cited by examiner

TWO-CYCLE ENGINE CYLINDER AND METHOD FOR MANUFACTURING THE SAME

CROSS-REFERENCE RELATED TO APPLICATIONS

This application is based on and claims priority to the Japanese Patent Application No. 2007-170276, filed Jun. 28, 2007, which is incorporated by reference in its entirety into this application.

BACKGROUND OF THE INVENTION

1. Field of the Invention

The present invention relates to an engine cylinder block for a two cycle combustion engine of an air scavenging type which may be used as a drive source for a portable work machine such as a brush cutter, and also to a method for manufacturing such engine cylinder block.

2. Description of the Prior Art

It is well known that some of the two-cycle combustion engines currently available in the market employ an engine cylinder block of a type, in which a scavenging passage defining wall is provided in a region confronting the cylinder bore so as to define a part of the scavenging passage communicating between a combustion chamber and a crankcase chamber. When this type of cylinder block is formed with the use of a molding die, a scavenging port defined above the scavenging passage defining wall is in the form as undercut.

The Japanese Laid-open Patent Publication No. 58-155114, published Sep. 14, 1983, discloses formation of the scavenging port by means of, for example, a cutting process with the use of a rotary cutter after the cylinder block has been die formed. According to this Patent Document, as shown in FIG. 18 of the accompanying drawings, each of the scavenging ports 91 open at respective portions of the inner peripheral wall of the cylinder block above the associated scavenging passages 92 is cut by a rotary cutter 80, that is inclined at an angle β relative to the longitudinal axis C of the cylinder bore so as to match with the angle of inclination of the scavenging port 91 with respect of such longitudinal axis C, so as to open into the cylinder bore.

Since the rotary cutter 80 is of a cylindrical shape, the rotary cutter 80 tends to be shifted in a direction towards the longitudinal axis C of the cylinder bore in the cylinder block 90 by the effect of a contact reaction acting on the rotary cutter from the inner peripheral surface of the cylinder block 90 during the course of cutting into the inner peripheral surface of the cylinder block 90 and, therefore, the cutting to define the respective scavenging ports 91 is difficult to achieve.

Also, the resultant scavenging ports 91, when viewed from the inside of the cylinder bore in the cylinder block 90, represents a shape generally complemental to the shape of the rotary cutter 80 with its height H constant in a transverse direction P as shown in FIG. 19. Accordingly, each scavenging port 91 has an upper edge 91*a* extending straight in a direction perpendicular to the longitudinal axis C of the cylinder bore in the cylinder block 90 and, therefore, a portion of a piston ring mounted on a reciprocating piston movable up and down within the cylinder bore tends to get stuck on the entire width W of the upper edge 91*a* of the respective scavenging port 91 at one time, with a scrabbling force consequently acting on the reciprocating piston. Once this occurs, the scrabbling force acts as a resistance to a smooth movement of the reciprocating piston within the cylinder bore.

Yet, since the upper edge 91*a* of each of the scavenging ports 91 extends straight, the scavenging ports are fully opened over the entire width W thereof from the very beginning of the scavenging stroke, accompanied by a rapid increase of the opening area of the scavenging ports to result in an occurrence of an undesirable blow-by of the scavenging gas from an exhaust port 93.

SUMMARY OF THE INVENTION

In view of the foregoing, the present invention has been devised to substantially eliminate the problems and inconveniences inherent in the prior art two-cycle combustion engine and is intended to provide a two-cycle combustion engine of an air scavenging type having scavenging ports of a design, in which workability is excellent, the resistance to movement of the reciprocating piston is minimized and the blow-by of gases is also minimized.

It is a related object of the present invention to provide a method for manufacturing a cylinder block for the two-cycle combustion engine of a kind referred to above.

In order to accomplish the foregoing object of the present invention, there is provided a cylinder block for a two-cycle combustion engine, which includes a scavenging port open at an inner peripheral surface of the cylinder block so as to orient diagonally upwardly relative to a longitudinal axis of a cylinder bore and defined in the cylinder block in communication with a combustion chamber, and an open edge of the scavenging port having an upper edge section which includes a flat region at an intermediate portion and at least one inclined region extending diagonally downwardly from one of opposite sides of the flat region to an associated side edge section.

According to the present invention, since an upper edge section of the open edge through which the scavenging port opens at the inner peripheral surface of the cylinder block is of a shape in which at least one side thereof is inclined downwardly, there is no possibility that the piston ring mounted on the reciprocating piston will get stuck on the entire upper edge section during the reciprocating movement of the piston. Therefore, the scrabbling force acting on the reciprocating piston through the piston ring is so reduced as to result in reduction in resistance to the piston and, in addition, since the opening area of the scavenging port at the initial stage of the scavenging stroke is reduced, the blow-by of the scavenging gas can be suppressed.

In one preferred embodiment of the present invention, the inclined region may have a width as measured in a direction conforming to the flat region, which is 0.3 to 0.8 times the width of the flat region. If the width of the inclined region is not greater than 0.3 times that of the flat region, the previously described effects of the inclined region will be low, but if it exceeds 0.8 times the width of the flat region, the opening area of the scavenging port will be so excessively small as to result in reduction of the scavenging efficiency.

In another preferred embodiment of the present invention, the inclined region may be inclined at an angle within the range of 5 to 25° relative to the flat region. If the angle of inclination of the inclined region is not greater than the lowermost limit of 5°, the previously described effects of the inclined region will be low, but if it exceeds the uppermost limit of 25, the opening of the scavenging port will be so excessively small as to result in reduction of the scavenging efficiency.

The present invention also provides a method for manufacturing a cylinder block for a two-cycle combustion engine. In the practice of this method, using a rotary cutting tool having an upper end face with an inclined surface inclined radially outwardly and downwardly at an outer periphery of the upper end face to form the scavenging port by cutting the cylinder block with the rotary cutting tool, then rotated about its own longitudinal axis, from radially inwardly of the cylinder bore to radially outwardly thereof. It is to be noted that the term "upwardly" hereinabove and hereinafter used is intended to mean a direction towards the top of the combustion chamber along the cylinder longitudinal axis and the term "downwardly" hereinabove and hereinafter used is intended to mean a direction counter to the upward direction along the cylinder longitudinal axis.

According to the method of the present invention, since the rotary cutting tool has the inclined surface formed in an outer periphery of the upper face thereof, the cutting to form the scavenging port that is inclined can be initiated with the longitudinal axis of the rotary cutting tool kept substantially parallel to the cylinder longitudinal axis. Accordingly, a wobbling of the rotary cutting tool by the effect of a contact reactive force occurring at the beginning of the cutting can be suppressed and as a result, the cutting workability can therefore be increased. Also, an upper edge section of the scavenging port is of a shape complemental to the upper face of the rotary cutting tool, that is, of a shape having its opposite sides inclined downwardly, there is no possibility that the piston ring mounted on the reciprocating piston will get stuck on the entire upper edge section and, therefore, the scrabbling force acting on the reciprocating piston through the piston ring is so reduced as to result in reduction in resistance to the piston and, in addition, since the opening of the scavenging port at the initial stage of the scavenging stroke can be reduced, the blow-by of the scavenging gas can be suppressed.

In the practice of the method referred to above, the cylinder block is preferably cut while the longitudinal axis of the rotary cutting tool is kept substantially parallel to the longitudinal axis of the cylinder. Since the cutting is so performed while the longitudinal axis of the rotary cutting tool is kept substantially parallel to the cylinder longitudinal axis, the processing of the scavenging port can be facilitated and the productivity of the cylinder block can be increased. Also, since the reactive force during the cutting occurs in a direction perpendicular to the longitudinal axis of the rotary cutting tool, that is, since the reactive force does not occur in a direction parallel to the longitudinal axis of the rotary shaft, it is possible to avoid any possible displacement and/or vibration of the rotary cutting tool.

In the practice of the method referred to above, the scavenging port is preferably formed by cutting the cylinder block with the rotary cutting tool, which is moved in directions radially and circumferentially of the cylinder bore.

According to this practice of the method, the scavenging port of a desired dimensions can be easily obtained when the rotary cutting tool is moved in directions radially and circumferentially of the cylinder block. Also, when the position of the longitudinal axis of the rotary cutting tool relative to the cylinder block is fixed, it is possible to avoid the contact reactive force on the rotary cutting tool occurring in a direction conforming to the longitudinal axis of the rotary cutting tool as hereinabove described, thus facilitating the cutting operation.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF THE PREFERRED EMBODIMENTS

Preferred embodiments of the present invention will now be described with reference to the accompanying drawings.

Figure 1:
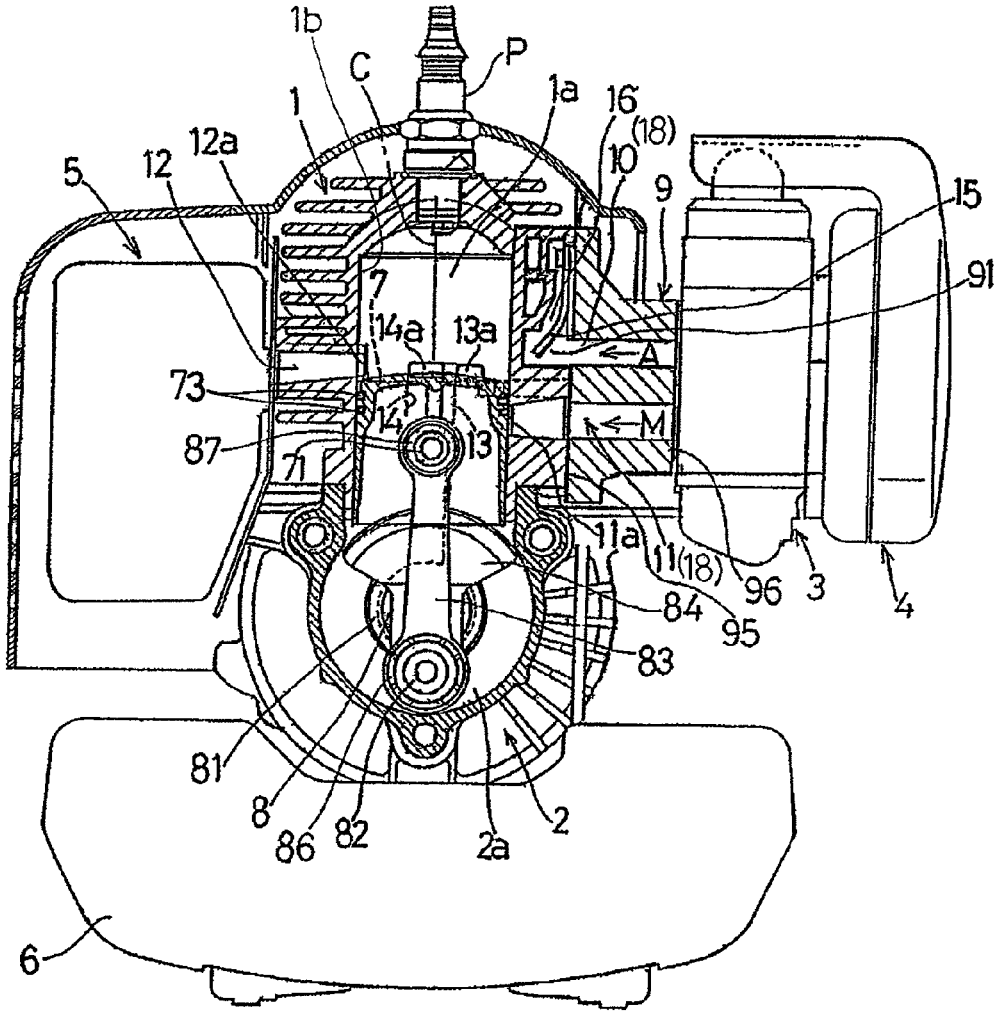
FIG. 1 is a longitudinal sectional view of a two-cycle combustion engine according to a first preferred embodiment of the present invention.

Referring first to FIG. 1 showing the first preferred embodiment of the present invention, there is shown a two-cycle combustion engine, particularly a two-cycle internal combustion engine including a cylinder block 1 and a crankcase 2 having an upper portion on which the cylinder block 1 is secured. The cylinder block 1 has a cylinder bore 1*b* and a combustion chamber 1*a* defined therein. The cylinder block 1 and the crankcase 2 are made of a metallic material such as an aluminum alloy and are so formed by the use of any known molding technique, for example, a die casting technique as is well known to those skilled in the art. The illustrated two-cycle combustion engine has a fuel intake system including a carburetor 3 and an air cleaner 4, both fluidly connected in series with each other with the carburetor 3 mounted on a side portion, for example, a right portion as viewed in FIG. 1, of the cylinder block 1 and also has an exhaust system including a muffler 5 provided on another side portion, for example, a left portion as viewed in FIG. 1, of the cylinder block 1. A fuel tank 6 accommodating a quantity of fuel is fitted to a bottom region of the crankcase 2.

The two-cycle combustion engine also includes a reciprocating piston 7 slidably accommodated within the cylinder bore 1*b* for movement in a direction, for example, in a vertical direction as viewed in FIG. 1, that is parallel to the longitudinal axis C of the cylinder bore 1*b* and defining the combustion chamber 1*a* between the top of the cylinder bore 1*b* and a top portion of the piston 7, in which chamber 1*a* the combustion of the air/fuel mixture takes place. The piston 7 has a piston ring 73 mounted on an upper portion thereof, thus sealing the space between the piston 7 and the cylinder wall defining the cylinder bore 1*b*.

The crankcase 2 accommodates therein a crankshaft 8 supported by crankshaft bearings 81 for rotation about its own longitudinal axis in a direction at right angles to the direction of movement of the piston 7. This crankshaft 8 has a pair of crank webs 84 connected together by means of a hollow crankpin 82 at a position offset from the longitudinal axis of the crankshaft 8. The reciprocating piston 7 referred to above is drivingly connected with the crankshaft 8 through a connecting rod 83 having a reduced diameter end, connected with a piston journal 87 fast with the piston 7, and also having a large diameter end connected with a crankpin journal 86.

An ignition plug P is replaceably mounted on a top portion of the cylinder block 1.

An insulator 9 is disposed between the cylinder block 1 and the carburetor 3 for minimizing conduction of a high temperature heat from the engine cylinder 1 to the carburetor 3. This insulator 9 has an air supply passage 10 defined in an upper portion thereof and also has an air/fuel mixture supply passage 11 defined in a lower portion thereof so as to extend generally parallel to the air supply passage 10. The air supply passage 10 and the air/fuel mixture supply passage 11 form respective parts of an intake passage 18.

The carburetor 3 referred to previously includes a rotary valve (not shown) operable to adjust the cross section of both of the air supply passage 10 and the mixture supply passage 11. The cylinder block 1 is also formed with an exhaust passage 12 open at an exhaust opening 12*a* in an inner peripheral surface of the cylinder block 1 in communication with the cylinder bore 1*b*. Exhaust gases as a product of combustion of an air/fuel mixture can be exhausted to the outside through the muffler 5 by way of the exhaust passage 12.

Figure 2:
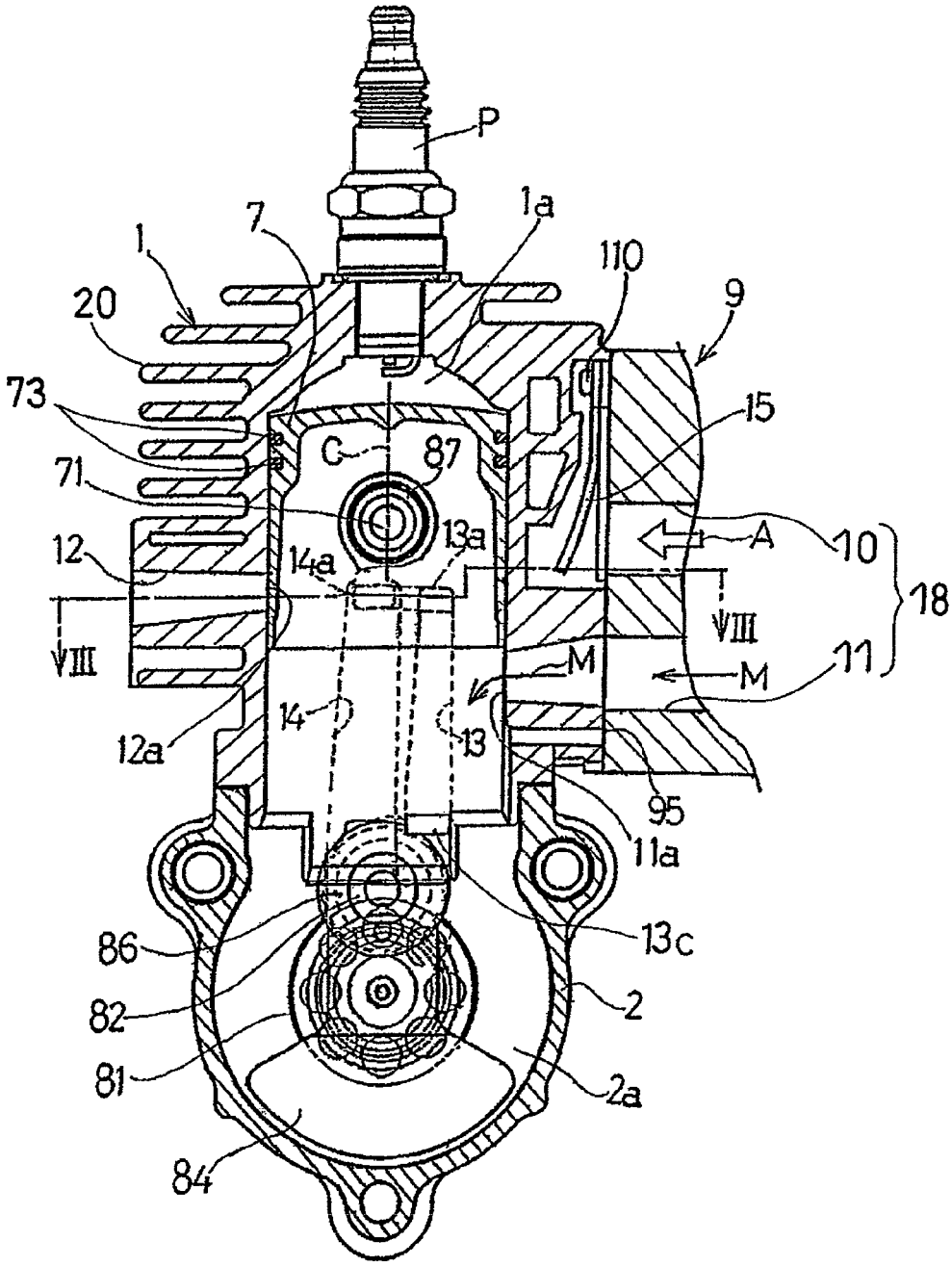
FIG. 2 is a longitudinal sectional view of the two-cycle combustion engine, showing a cylinder block and a crankcase on an enlarged scale.

As best shown in FIG. 2, a pair of air/fuel mixture scavenging passages 13 for directly communicating between the combustion chamber 1*a* and a crankcase chamber 2*a* within the crankcase 2 are formed in part in the cylinder block 1 and in part in the crankcase 2 so as to extend generally vertically. Similarly, a pair of air scavenging passages 14 for communicating between the combustion chamber 1*a* and the crankcase chamber 2*a* through the crankshaft bearings 81 are formed in part in the cylinder block 1 and in part in the crankcase 2 so as to extend generally vertically and on one lateral side of the air/fuel mixture scavenging passage 13 adjacent the exhaust port 12*a*.

Figure 3:
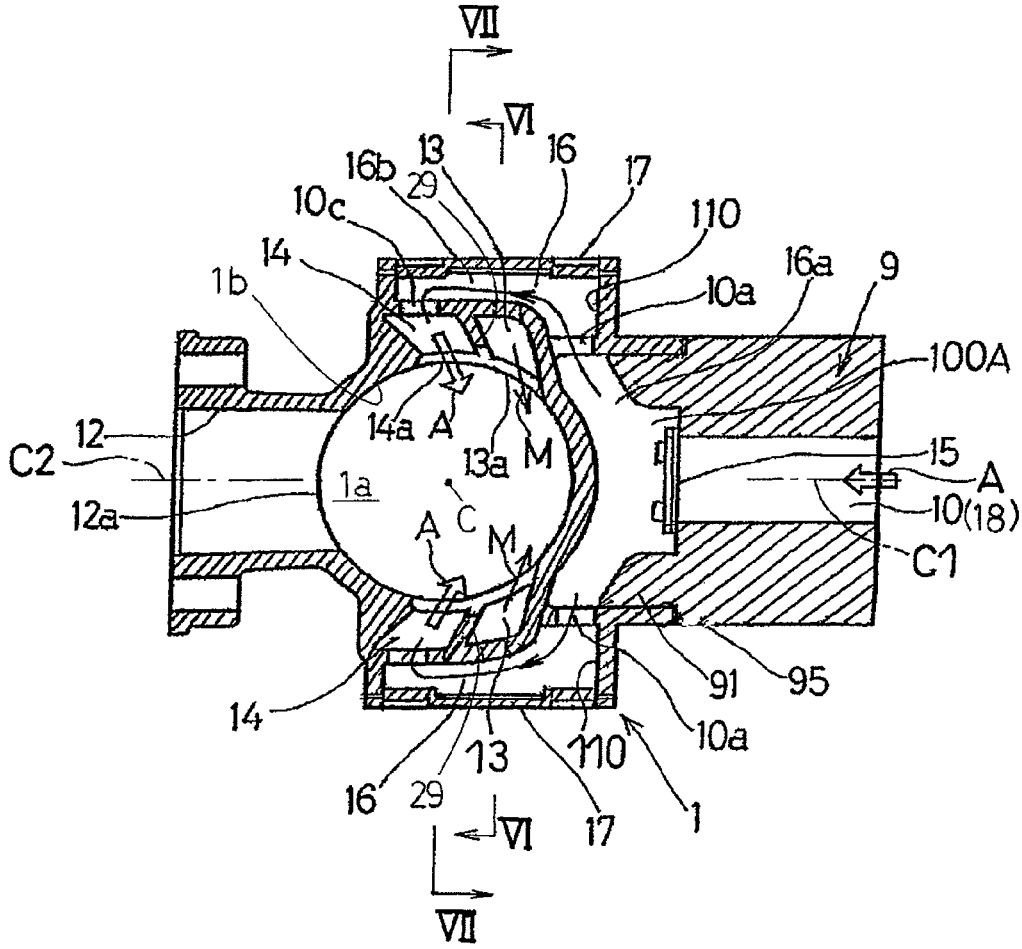
FIG. 3 is a cross-sectional view taken along the line III-III in FIG. 2.

As best shown in FIG. 3, which illustrates a cross sectional view taken along the line III-III in FIG. 2, respective longitudinal axes C1 and C2 of the air supply passage 10 and the exhaust passage 12, when viewed in a direction conforming to the longitudinal axis C of the cylinder bore 1*b*, lie generally in alignment with each other. The pair of the mixture scavenging passage 13 are positioned in symmetrical relation to each other with respect to the longitudinal axis of the intake passage 18, that is, the longitudinal axis C1 of the air supply passage 10 or C2 of the exhaust passage 12. Similarly, the pair of the air scavenging passages 14 are positioned in symmetrical relation to each other with respect to the longitudinal axis of the intake passage 18, that is, the longitudinal axis C1 of the air supply passage 10 or C2 of the exhaust passage 12. The mixture scavenging passages 13 and the air scavenging passages 14 are separated from each other by respective partition walls 29.

As best shown in FIG. 2, the mixture scavenging passages 13 have respective mixture scavenging ports 13*a* and the air scavenging passages 14 have respective air scavenging ports 14*a*. An upper edge section of each of the air scavenging ports 14*a*, each defined in an upper end of the corresponding air scavenging passage 14 is so positioned at a level higher than an upper edge section of each of the mixture scavenging ports 13*a*, each defined at an upper end of the corresponding mixture scavenging passage 13, but lower than an upper edge section of the exhaust port 12*a*. Then, during the scavenging stroke of the two-cycle combustion engine, the air can be introduced into the combustion chamber 1*a* earlier than the air/fuel mixture M to perform a scavenging operation. Respective mixture scavenging ports 13*a* and air scavenging ports 14*a* are so diagonally upwardly oriented in the cylinder block 1 as to open at the inner peripheral surface of the cylinder block 1 in communication with the combustion chamber 1*a*.

The air A flowing through the air supply passage 10 defined in the insulator 9 is temporarily introduced into the air scavenging passages 14 through a pair of air introducing passages 16, as will be described later with reference to FIG. 3, by the effect of a negative pressure, which is developed within the crankcase chamber 2*a* during the intake stroke in which the piston 7 ascends within the cylinder bore 1*b*. On the other hand, the air/fuel mixture M flowing through the mixture supply passage 11 defined in the insulator 9 is introduced directly into the crankcase chamber 2*a* through a mixture port 11*a*, defined in the inner peripheral surface of the cylinder block 1, by the effect of the negative pressure when during the intake stroke the piston 7 ascends within the cylinder bore 1*b*.

Figure 4:
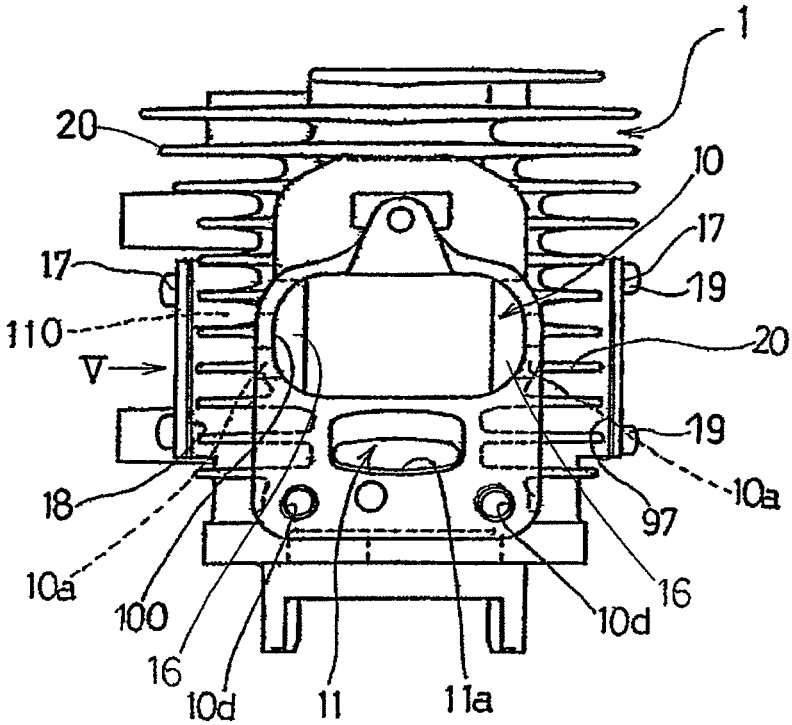
FIG. 4 is a side view showing a cylinder block employed in the two-cycle combustion engine.

Referring now to FIG. 3, the air introducing passages 16 are defined within the cylinder block 1 so as to extend in a direction generally perpendicular to the longitudinal axis C of the cylinder bore 1*b* so that the air A flowing in the air supply passage 10 can be introduced into the air scavenging passages 14. The insulator 9 is formed integrally with protrusions 91 protruding into the cylinder block 1 as will be described later, to form respective wall surfaces of the air introducing passages 16. As best shown in FIG. 4, a first recess 100 is formed in the cylinder block 1 so as to define an upstream portion 16*a* of each of the air introducing passages 16 at a location opposed to the exhaust port 12*a* shown in FIG. 3. This recess 100 is formed simultaneously with the die casting of the cylinder block 1 so as to open in a direction opposed to the exhaust port 12*a* shown in FIG. 3, that is, in a direction parallel to the air supply passage 10. The protrusions 91 described above protrude into the recess 100 to define the upstream portion 16*a* of each of the air introducing passages 16. In addition to the insulator 9, side covers 17 forming side walls of the cylinder block 1 are secured to opposite side portions of the cylinder block 1 so as to define downstream portions 16*b* of the air introducing passages 16.

As shown in FIG. 3, the air supply passage 10 has a downstream port defined in a portion of the insulator 9 in communication with the air introducing passages 16, and a reed valve 15 is fitted to the insulator 9 so as to selectively open or close the downstream port of the air supply passage 10. Specifically, this reed valve 15 is operable to close the downstream port of the air supply passage 10 when a negative pressure developed within the air introducing passages 16 increases to a value equal to or higher than a predetermined value to thereby interrupt the supply of air from the air supply passage 10 into the air introducing passages 16.

Referring still to FIG. 3, in addition to the first recess 100 referred to above and communicated with the air supply passage 10 through the reed valve 15, the cylinder block 1 is also formed with second recesses 110 defined radially outwardly of the cylinder bore 1*b* and laterally outwardly of the mixture and air scavenging passages 13 and 14, which recesses 110 are closed by the respective side covers 17 to define the downstream portions 16*b* of the air introducing passages 16 as hereinabove described. Those downstream portions 16*b* of the air introducing passages 16 extend radially outwardly of the cylinder bore 1*b* past the mixture scavenging passage 13 and terminate in communication with the air scavenging passages 14.

The side covers 17 referred to above are fixedly connected to the respective opposite side portions of the cylinder block 1 by means of set screws 19 with a gasket 97 intervening between each of the side covers 17 and the corresponding side portion of the cylinder block 1 as shown in FIG. 4.

The cylinder block 1 so far described above is so designed that the air A flowing through the air supply passage 10 can be introduced from the respective air inlet ports 10*c* into the air scavenging passages 14 after flowing through the air introducing passages 16 when the reed valve 15 is opened. The upstream portions 16*a* and downstream portions 16*b* of the air introducing passages 16 are communicated with each other through respective communicating ports 10*a* defined in the cylinder block 1.

Figure 5:
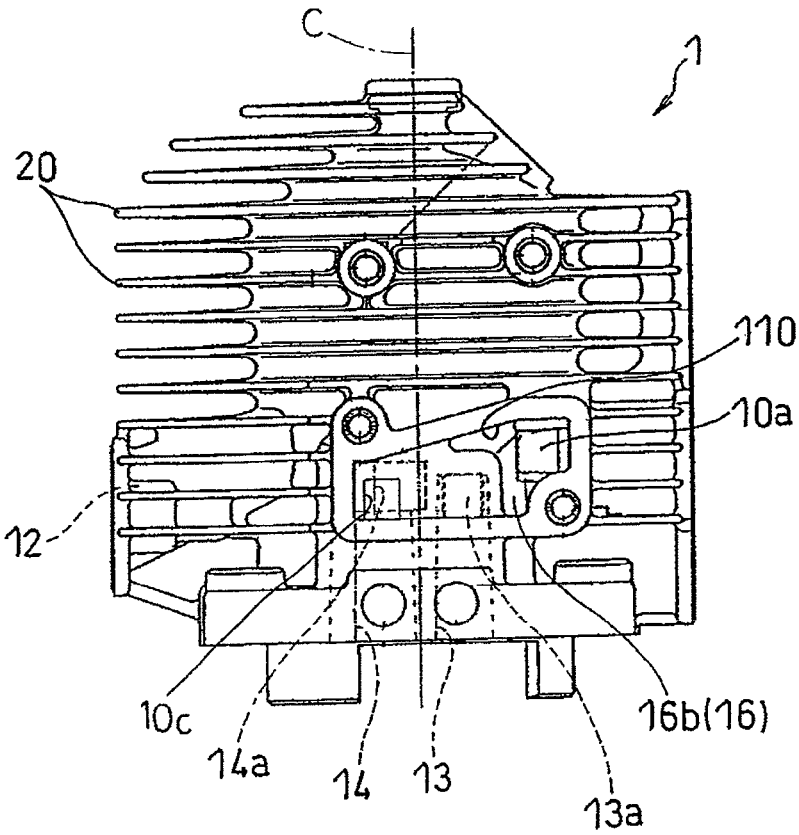
FIG. 5 is a side view of the cylinder block as viewed in a direction indicated by the arrow-headed line V in FIG. 4.

FIG. 5 illustrates a side view of the cylinder block as viewed in a direction indicated by the arrow-headed line V in FIG. 4, with one of the side covers 17 removed to show the details inside the corresponding second recess 110. As shown in FIG. 5, the second recesses 110 have air inlet ports 10*c* defined therein together with the communicating ports 10*a* communicated with the respective air scavenging passages 14. The downstream portions 16*b* of the air introducing passages 16 extend between the communicating ports 10*a* and the air inlet ports 10*c*, respectively. Accordingly, the air A can be introduced from the communicating ports 10*a* into the air scavenging passages 14 through the downstream portions 16*b* of the air introducing passages 16 by way of the air inlet ports 10*c*, respectively.

Figure 6:
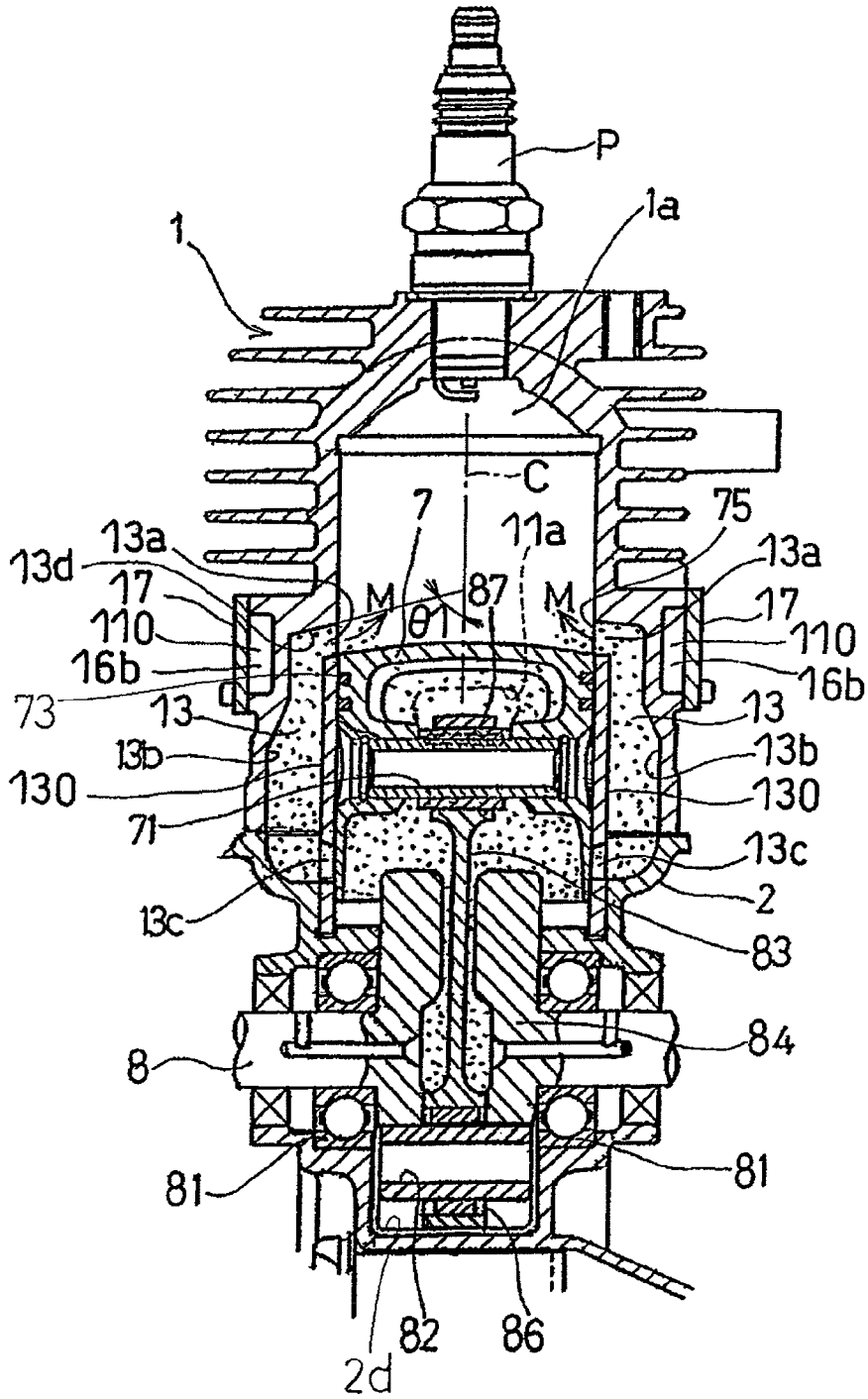
FIG. 6 is a cross-sectional view taken along the line VI-VI in FIG. 3, showing scavenging passages through which a mixed fuel is supplied.

Referring to FIG. 6, each of the mixture scavenging passages 13 shown therein includes a mixture scavenging port 13*a* open at the inner peripheral surface of the cylinder block 1 in communication with the cylinder bore 1*b*, a communicating passageway 13*b* extending vertically downwardly from the mixture scavenging port 13*a* to an upper region of the crankcase 2 past a lower end of the cylinder block 1, and a inflow port 13*c* open at an inner peripheral surface of that upper region of the crankcase 2. A side portion of the communicating passageway 13*b* of each mixture scavenging passage 13 adjacent the cylinder bore 1*b* is covered by a first scavenging passage wall 130, and the mixture scavenging port 13*a* and the inflow port 13*c* are defined at locations above and below the first scavenging passage wall 130, respectively. An upper surface 13*d* of each of the mixture scavenging passages 13 is inclined upwardly towards the longitudinal axis C of the cylinder bore 1*b* at an angle θ1 that is chosen to be 72° relative to the longitudinal axis C of the cylinder bore 1*b* (which angle θ1 is hereinafter referred to as a horizontal angle). Thus, the air/fuel mixture M introduced from the mixture supply passage 11 (shown in FIG. 2) into the crankcase chamber 2*a* is blown diagonally upwardly from the mixture scavenging ports 13*a* into the combustion chamber 1*a* during the scavenging stroke with the piston 7 then descending.

Figure 7:
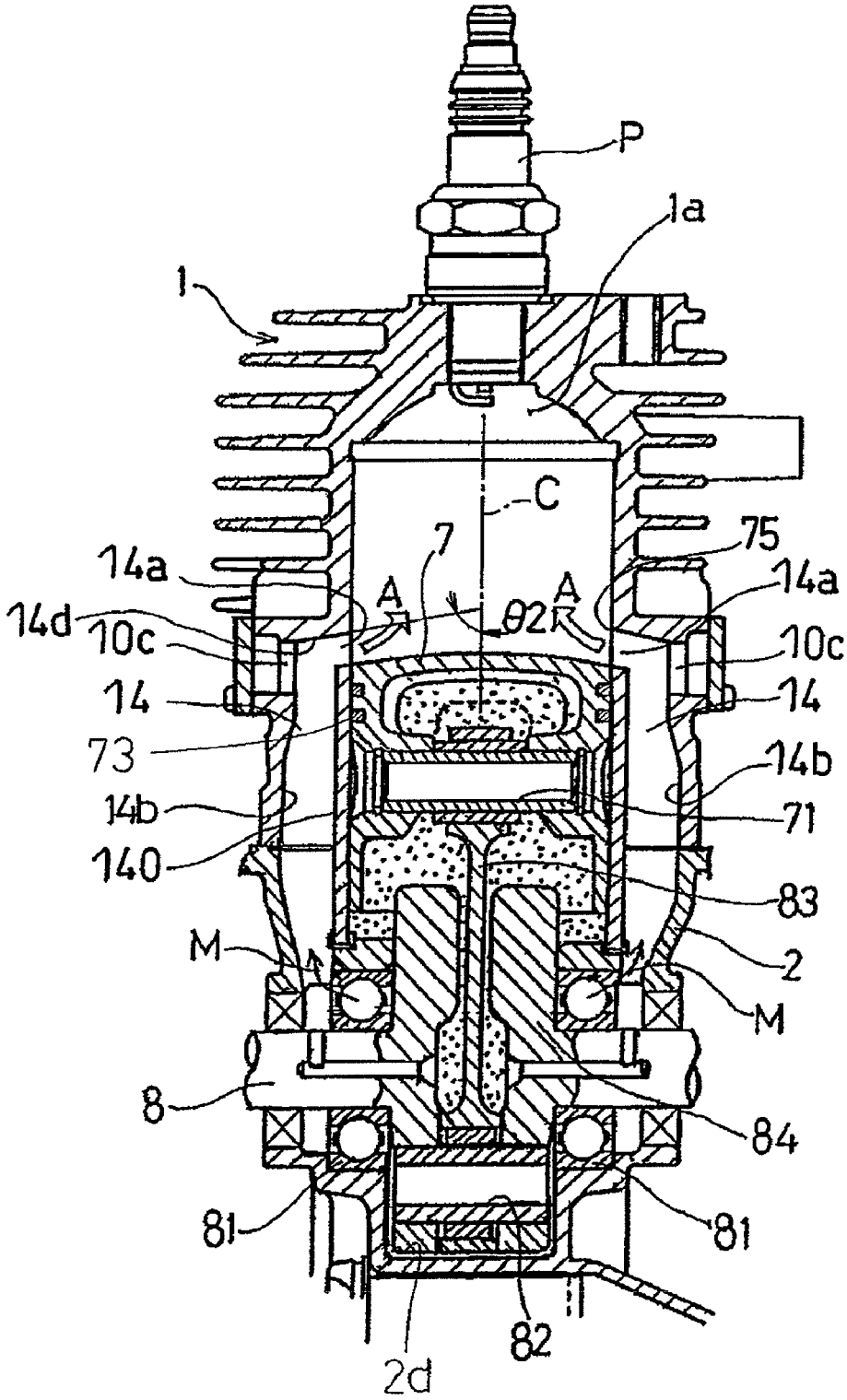
FIG. 7 is a cross-sectional view taken along the line VII-VII in FIG. 3, showing scavenging passages through which an air is supplied.

As best shown in FIG. 7, each of the air scavenging passages 14 includes an air scavenging port 14*a* open at the inner peripheral surface of the cylinder block 1 in communication with the cylinder bore 1*b*, and a communicating passageway 14*b* extending vertically from the air scavenging port 14*a* past the lower end of the cylinder block 1 down to an outer side face of the adjacent crankshaft bearing 81 that is located at a position generally intermediate of the height of the crankcase 2. A side portion of the communicating passageway 14*b* of each air scavenging passage 14 adjacent the cylinder bore 1*b* is covered by a second scavenging passage wall 140, and an air scavenging port 14*a* is defined at locations above the second scavenging passage wall 140. The respective communicating passageway 14*b* has a lower end communicated with the crankcase chamber 2*a* through a gap between inner and outer races of the associated crankshaft bearing 81 and then through a gap between the adjacent crank web 84 and the associated bearing 81.

An upper surface 14*d* of each of the air scavenging passages 14 is inclined upwardly towards the longitudinal axis C of the cylinder bore 1*b* at an angle (horizontal angle) θ2 that is chosen to be 80° relative to the longitudinal axis C of the cylinder bore 1*b*. Thus, the air A introduced from the air supply passage 10 (shown in FIG. 3) into the air scavenging passages 14 through the air introducing passages 16 is blown diagonally upwardly from the air scavenging ports 14*a* into the combustion chamber 1*a* during the scavenging stroke with the piston 7 then descending. Accordingly, the air A so introduced into the combustion chamber 1*a* blocks the air/fuel mixture M to thereby suppress a blow-by of the air/fuel mixture from the exhaust passage 12 to the outside effectively.

As FIG. 4 makes it clear, a downstream portion of the mixture supply passage 11 is formed in a lower region of each of the first recess 100 opening towards the outside of the cylinder block 1, an exit of which forms a mixture supply port 11*a* opening at the inner peripheral surface of the cylinder block 1. Respective peripheral edges of the air supply passage 10 and the mixture supply passage 11 form a flat surface and, as best shown in FIG. 3, a portion of the insulator 9 is held under pressure in contact therewith through a gasket 95. Specifically, the insulator 9 is fixed to the cylinder block 1 with screw members threaded into corresponding screw holes 10*d* (FIG. 4) in the cylinder block after having been passed through respective mounting holes (not shown) defined in the insulator 9 shown in FIG. 3.

The operation of the two-cycle combustion engine of the structure described above will now be described. When the piston 7 within the cylinder bore 1*b* in the cylinder block 1 during the intake stroke arrives at the top dead center as shown in FIG. 2 and the cylinder bore 1*b* and the crankcase chamber 2*a* are held in a negative pressure, the air/fuel mixture M is introduced directly into the crankcase chamber 2*a* through the mixture port 11*a* open at the inner peripheral surface of the cylinder block 1. The air/fuel mixture M so introduced is utilized to lubricate the large diameter end bearing, i.e., the crankpin journal 86 and the small diameter end bearing or piston journal 87. At this time, since the air scavenging passages 14 communicated with the crankcase chamber 2*a* through the crankshaft bearings 81 are also held in a negative pressure, the air introducing passages 16 communicated respectively with those air scavenging passages 14 is hence held in a negative pressure and, accordingly, the reed valve 15 disposed at the outlet of the air supply passage 10 in the insulator 9 is opened to allow the air A from the air supply passage 10 to be temporarily introduced into the air scavenging passages 14 through the air introducing passages 16. In this way, when the reed valve 15 is opened by the effect of the negative pressure within the crankcase chamber 2*a* shown in FIG. 2 during the intake stroke, the air A flowing through the air supply passage 10 is introduced at all times into the air scavenging passages 14. For this reason, a sufficient amount of air necessary to avoid the blow-by can be secured within the air scavenging passages 14.

During the subsequent scavenging stroke, the air/fuel mixture M from the mixture scavenging ports 13*a* of the mixture scavenging passages 13 and the air A from the air scavenging ports 14*a* of the air scavenging passages 14 are introduced into the combustion chamber 1*a*. At this time, since the air A is first introduced from the air scavenging ports 14*a* into the combustion chamber 1*a* and the air/fuel mixture M is then introduced from the mixture scavenging ports 13*a* into the combustion chamber 1*a* at a timing slightly delayed relative to the introduction of the air A from the air scavenging ports 14*a* and since the air A is so introduced into the combustion chamber 1*a* at a locations closer to the exhaust port 12 than the air/fuel mixture M, that is, the air scavenging ports 14*a* are located on one side of the mixture scavenging ports 13*a* adjacent the exhaust port 12, combustion gases can be discharged from the exhaust port 12*a* by the action of the air A introduced earlier than the air/fuel mixture M and, therefore, the blow-by of the air/fuel mixture M from the exhaust port 12*a* can be avoided.

When the air A from the air scavenging passages 14 shown in FIG. 7 is introduced into the combustion chamber 1*a* in the manner described above, a portion of the air/fuel mixture M within the crankcase chamber 2*a* flows into the air scavenging passages 14 through the gap between the crankshaft bearings 81 and, therefore, the crankshaft bearings 81 are lubricated by a fuel component contained in such air/fuel mixture M.

Since as hereinbefore described, the air introducing passages 16 through which the air flowing in the air supply passage 10 can be introduced into the air scavenging passages 14 are so formed in the cylinder block 1 as to extend laterally outwardly of the mixture scavenging passages 13 in the cylinder block 1, the use of component parts such as connecting pipes and clamps can be dispensed with and, therefore, the number of component parts used and the number of assembling steps required can be reduced advantageously. Also, since the air introducing passages 16 is defined by the first recess 100 and the protrusions 91 of the insulator 9 protruding thereinto by mean of a casting technique, the recess 100 in the cylinder block 1 can be formed having a simplified shape, resulting in minimization of the cost of manufacture of the cylinder block 1.

The first, large recess 100 formed in the cylinder block 1 by means of a casting technique to form the air introducing passages 16 therein are infilled with the protrusions 91 formed integrally with the insulator 9 and are therefore narrowed and the capacity of the crankcase chamber 2*a* communicated with the first recess 100 is therefore substantially reduced. Accordingly, the air A can have a sufficient blow pressure during the scavenging stroke.

Hereinafter, a method for manufacturing the cylinder block that is used in the two-cycle combustion engine of the construction hereinabove described will be described with particular reference to FIGS. 8 to 16. The cylinder block making method of the present invention is essentially featured in that a rotary cutting tool used to form the scavenging ports by means of a cutting technique has a unique shape different from that of the conventionally utilized cutter of a similar kind.

Figure 8:
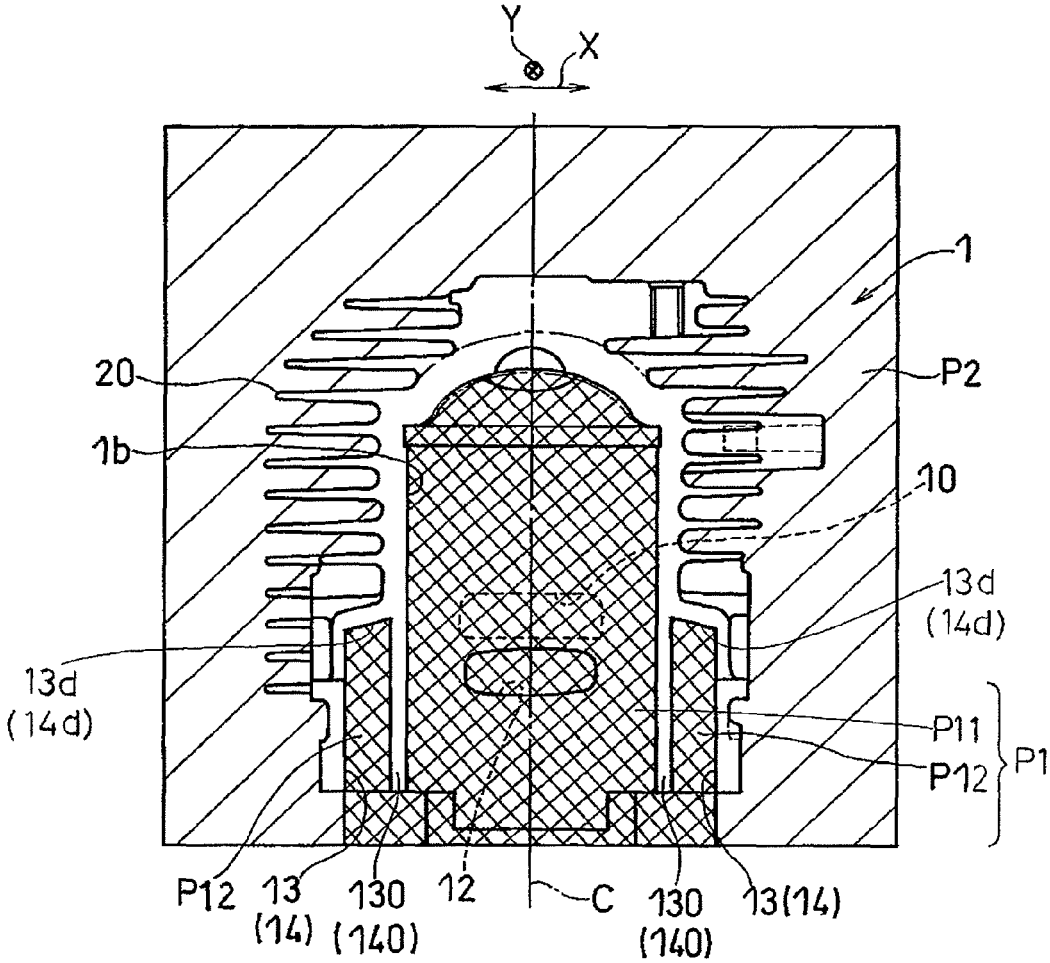
FIG. 8 is a schematic longitudinal sectional view of a mold assembly used to manufacture the cylinder block.

Referring now to FIG. 8, there is shown a schematic longitudinal sectional view of a mold assembly used to cast the cylinder block. As shown therein, during the die casting of the cylinder block 1, the cylinder bore 1*b* and the two pairs of the scavenging passages 13 and 14 are formed by drawing an inner mold P1 downwardly along the longitudinal axis C of the cylinder block 1. The mold P1, which forms the inner mold, is of a shape including a bore forming portion P11 complemental in shape to and eventually forming the cylinder bore 1*b*, and scavenging passage forming portions P12 eventually forming the scavenging passages 13 and 14 except for the scavenging ports 13*a* and 14*a*. Each of the forming portions P11 and P12 is so shaped as to taper upwardly to allow it to have a draft angle. The bore forming portion P11 and the scavenging passage forming portions P12 are not communicated with each other in a direction radially of the cylinder bore 1*b* and scavenging passage walls 130 and 140 are formed within a space therebetween. Also, the scavenging passage forming portions P12 has respective upper end faces inclined upwardly towards the longitudinal axis C of the cylinder bore 1*b* so as to complement with the mixture scavenging ports 13*a* of the mixture scavenging passages 13 and the air scavenging ports 14*a* of the air scavenging passages 14.

Figure 9:
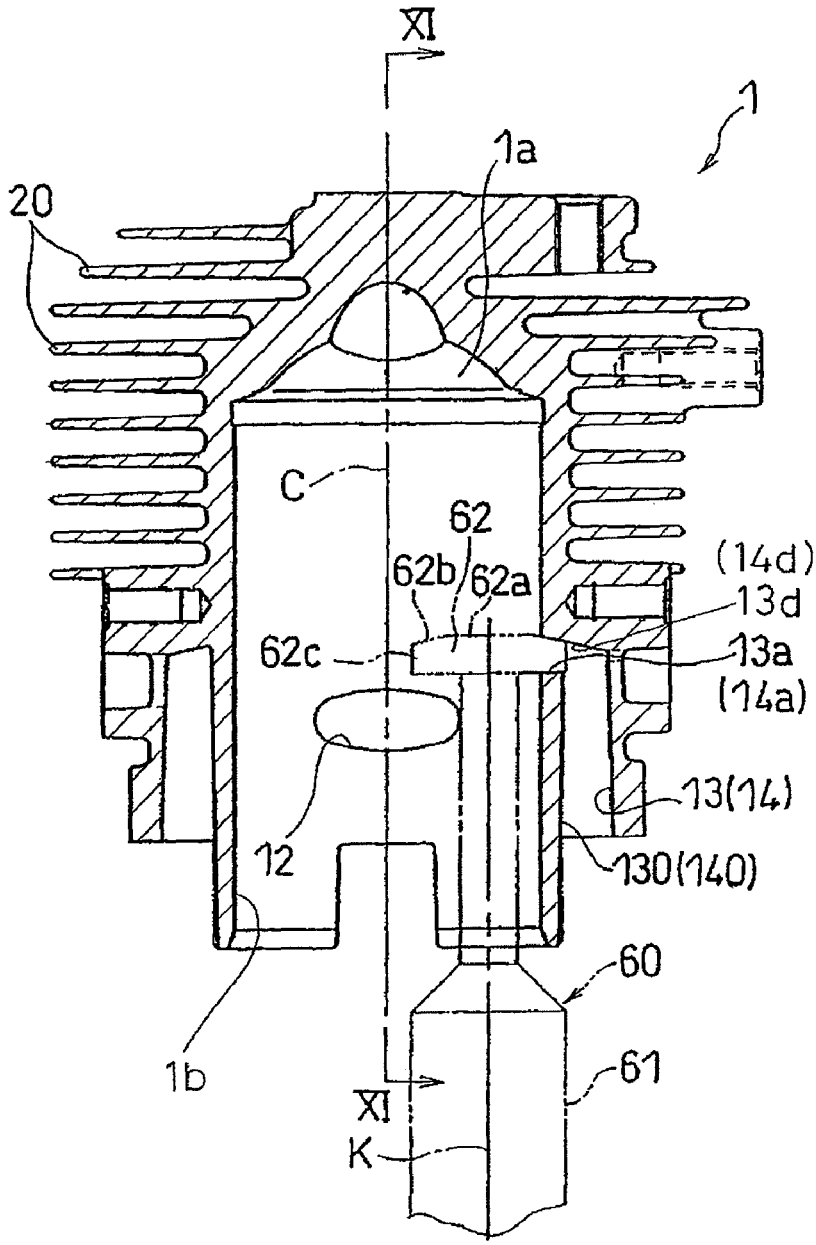
FIG. 9 is a longitudinal sectional view of the two-cycle combustion engine, showing a process of forming scavenging ports with the use of a rotary cutting tool.

The cylinder block 1 has its contour molded by a separated outer mold P2 that can be moved in a forward and rearward direction X and also in a left and right direction Y. After the molding of the cylinder block 1 with those molds P1 and P2, the mixture scavenging ports 13*a* of the mixture scavenging passages 13 and the air scavenging ports 14*a* of the air scavenging passages 14 are formed by means of a cutting technique with the use of a cutting unit 60 as shown in FIG. 9. The cutting unit 60 includes a stepped rotary shaft 61 drivingly coupled with a drive source (not shown) and a rotary cutting tool 62 fixed to a tip of the rotary shaft 61. This rotary cutting tool 62 has cutting blades which may be made of either a metallic material or a ceramic material or may be a grinding stone containing abrasive coating particulates bound by a binding material.

Figure 10A:
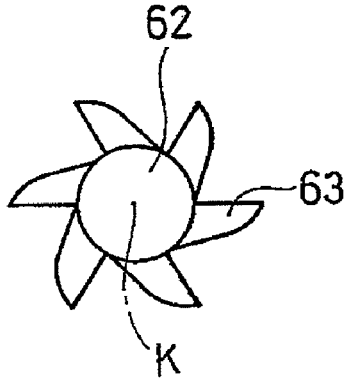
FIG. 10A is a top plan view showing the rotary cutting tool.
Figure 10B:
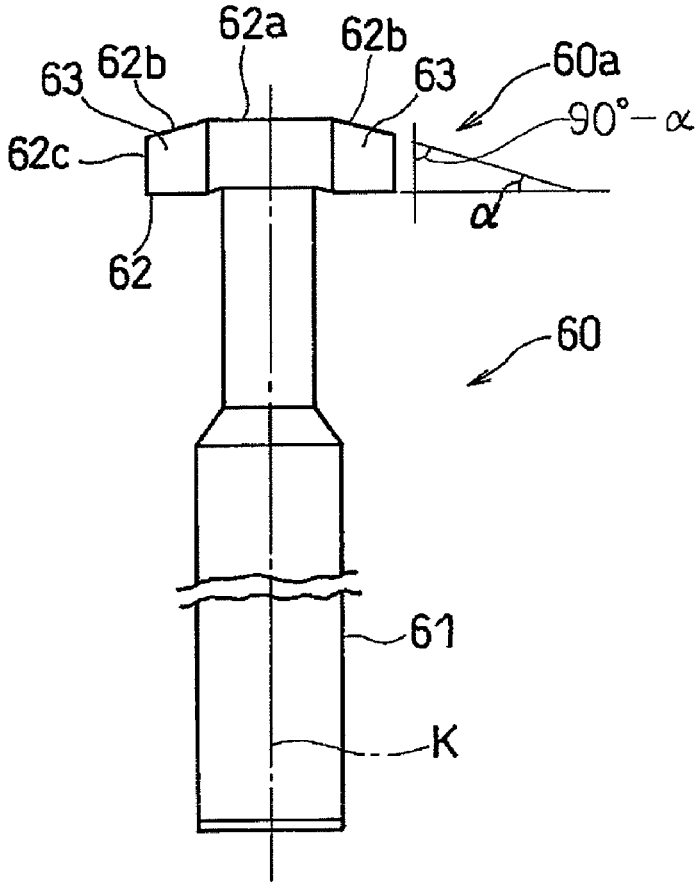
FIG. 10B is a front elevational view of the rotary cutting tool.

Referring to FIGS. 10A and 10B, the rotary cutting tool 62 has a periphery provided with a plurality of cutting blades 63, and includes a flat surface 62*a* formed in an upper end face of the rotary shaft 61 so as to lie perpendicular to the longitudinal axis K of the rotary shaft 61, inclined surfaces 62*b* formed at an outer periphery of the upper end face so as to incline radially outwardly and downwardly from a periphery of the flat surface 62*a* to outer peripheral faces 62*c*. The angle cc of inclination of each inclined surface 62*b* relative to the flat surface 62*a* is chosen to be, for example, 14° so as to obtain a value intermediate between the horizontal angle θ1 of the mixture scavenging passages 13 and the horizontal angle θ2 of the air scavenging passages 14 shown respectively in FIGS. 6 and 7.

It is to be noted that the shape of the rotary cutting tool 62 means the contour of an area in which the rotary cutting tool 62, when rotated about its own longitudinal axis K, moves. The shape of the rotary cutting tool 62 may be either a cylindrical shape such as shown in FIG. 10 (having a portion of which radial dimension is constant along the longitudinal axis K) or a conical shape having a vertex of an angle (152°) that is twice the value (76°) intermediate between the horizontal angles θ1 and θ2 shown respectively in FIGS. 6 and 7. In the case of the cylindrical shape represented by the rotary cutting tool 62, outer peripheral faces of the rotary cutting tool 62 will be brought in surface-to-surface contact with the inner peripheral surface of the cylinder block 1 during the cutting operation and, as compared with the line contact or the point contact, no large reactive force acts on the rotary cutting tool 62 locally, and, therefore, fluttering of the rotary cutting tool 62 can be minimized.

The inclined surfaces 62*b* of the rotary cutting tool 62*b* may extend either straight or curved. Where the inclined surfaces 62*b* are curved, the angle of inclination a of each inclined surface 62*b* is represented by the angle of inclination relative to tangential line at a radial center of each inclined surface 62*b*.

Figure 11:
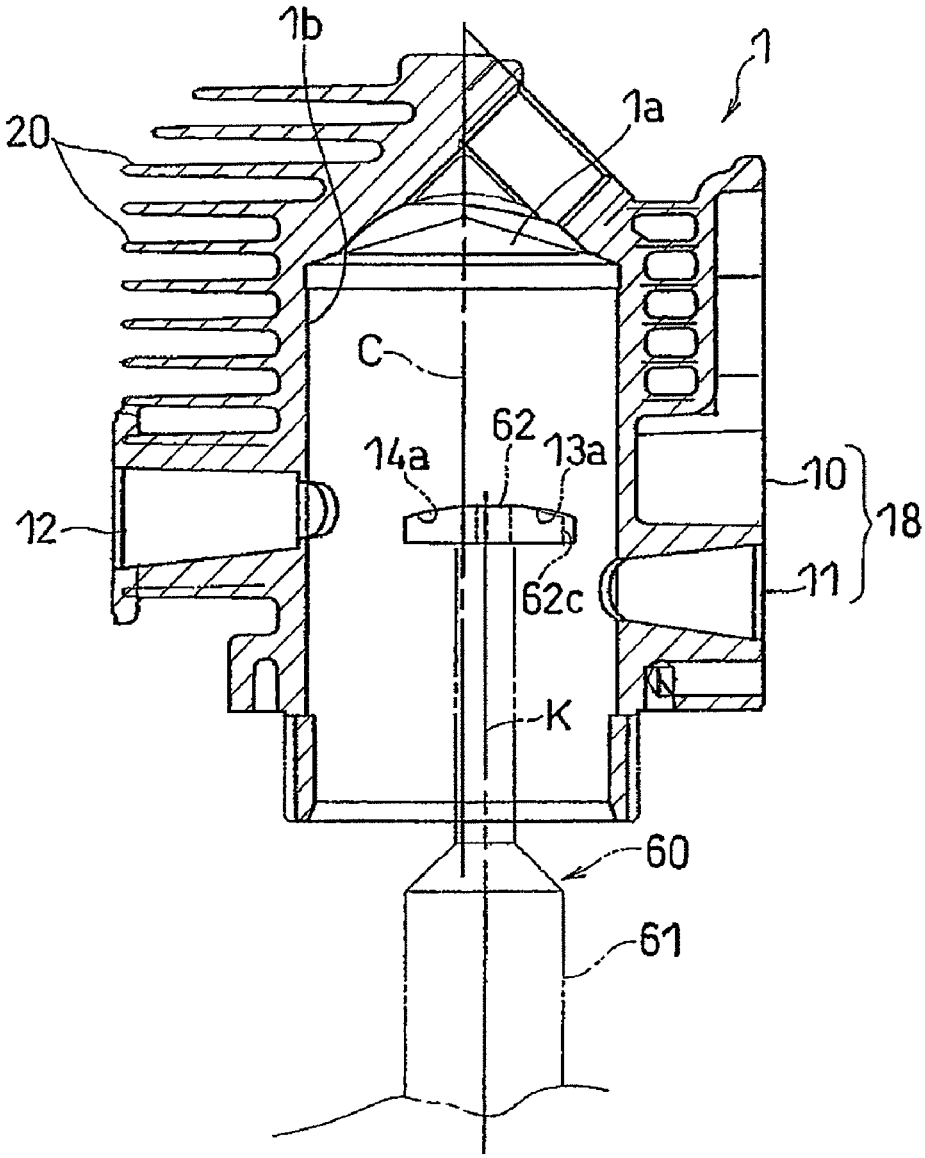
FIG. 11 is a longitudinal sectional view of the cylinder block of the two-cycle combustion engine, showing the rotary cutting tool inserted into a cylinder bore to form a scavenging port.
Figure 12:
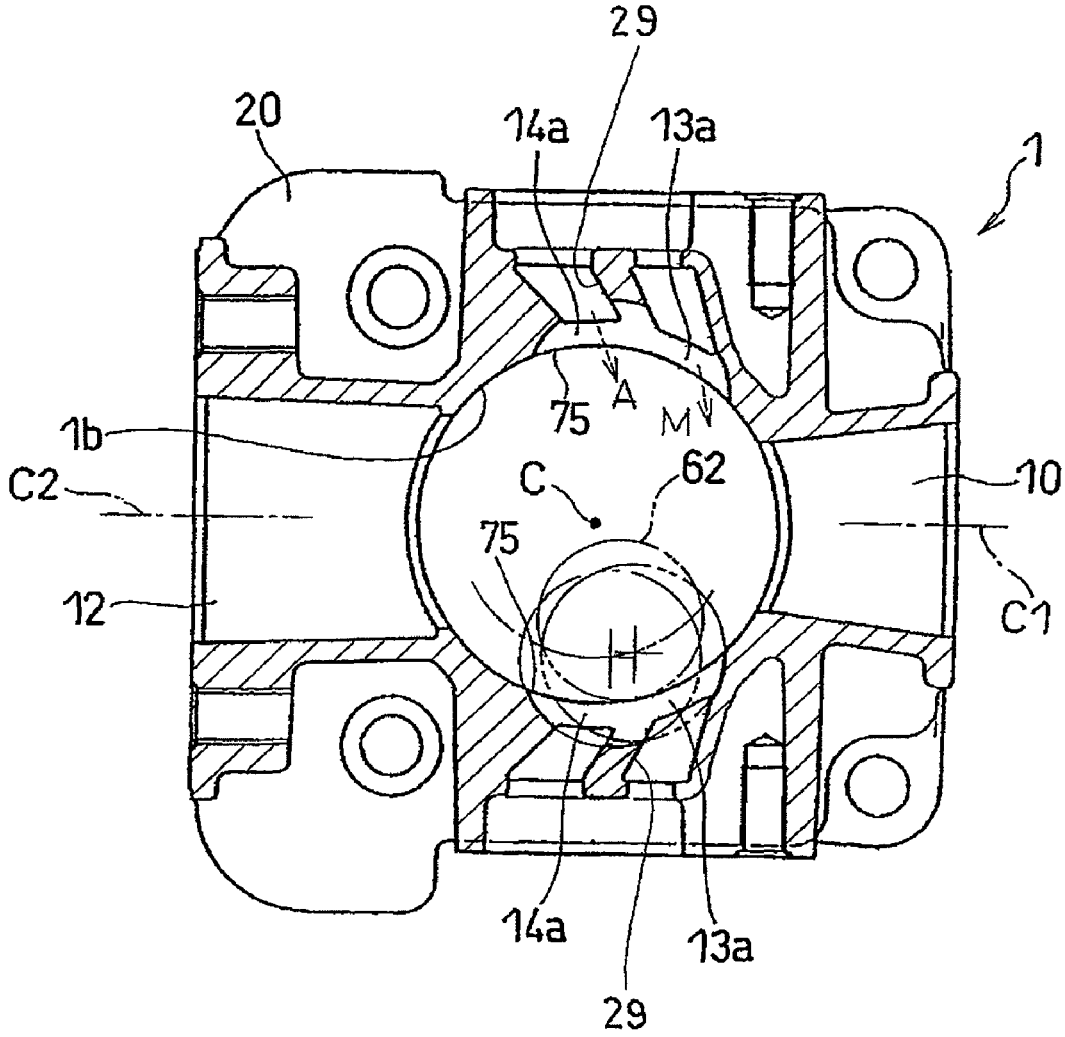
FIG. 12 is a transverse sectional view showing an essential portion of the cylinder block.

FIG. 11 illustrates a cross sectional view taken along the line XI-XI in FIG. 9, showing the manner of formation of the scavenging port with the use of the cutter. As shown therein, the rotary cutting tool 62 is inserted into the cylinder bore 1*b* from bottom of the cylinder block 1 and is repositioned at a location aligned with a portion of the inner peripheral surface of the cylinder block 1 where the scavenging port is desired to be formed. Then, the rotary cutting tool 62 is driven about the longitudinal axis K of the rotary shaft 61 and, while the longitudinal axis K of the rotary cutting tool 62 is kept substantially parallel to the longitudinal axis C of the cylinder bore 1*b*, the rotary cutting tool 62 is moved in a direction radially of and also in a direction circumferentially of the cylinder bore 1*b*, as shown in FIG. 12, to thereby execute the cutting.

The rotary cutting tool 62 does not move in a direction parallel to the longitudinal axis C of the cylinder bore 1*b*. Accordingly, the behavior of the rotary cutting tool 62 is so simple that formation of the scavenging port can be facilitated, resulting in increase of the productivity of the cylinder block. Also, since the reactive force during the cutting is generated in a direction perpendicular to the longitudinal axis K of the rotary cutting tool 62, that is, since the reactive force does not occur in a direction parallel to the longitudinal axis K of the rotary shaft 61, it is possible to avoid any possible displacement and/or vibration of the rotary cutting tool 62.

Figure 13:
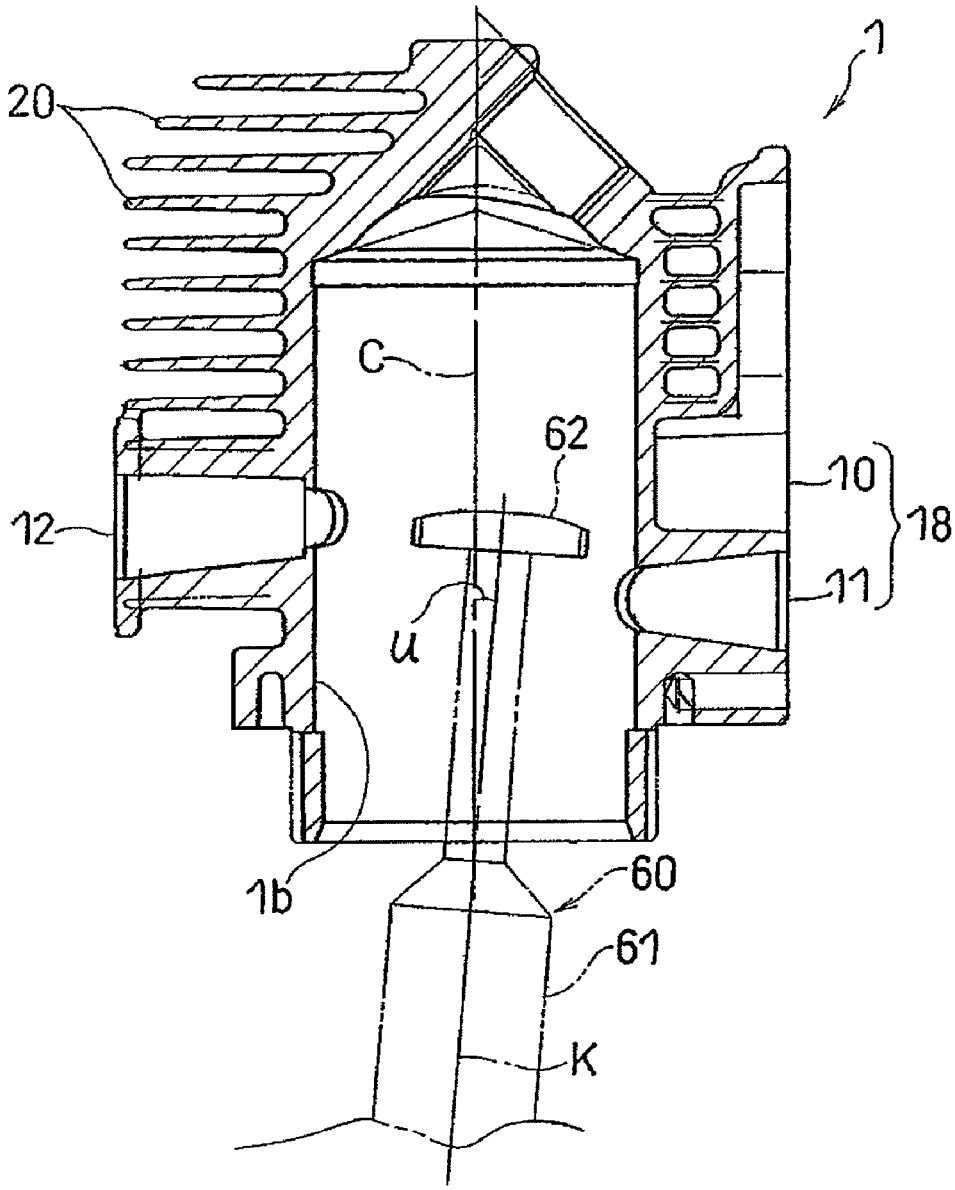
FIG. 13 is a longitudinal sectional view of the cylinder block, showing the rotary cutting tool inclined to form the scavenging port.
Figure 14:
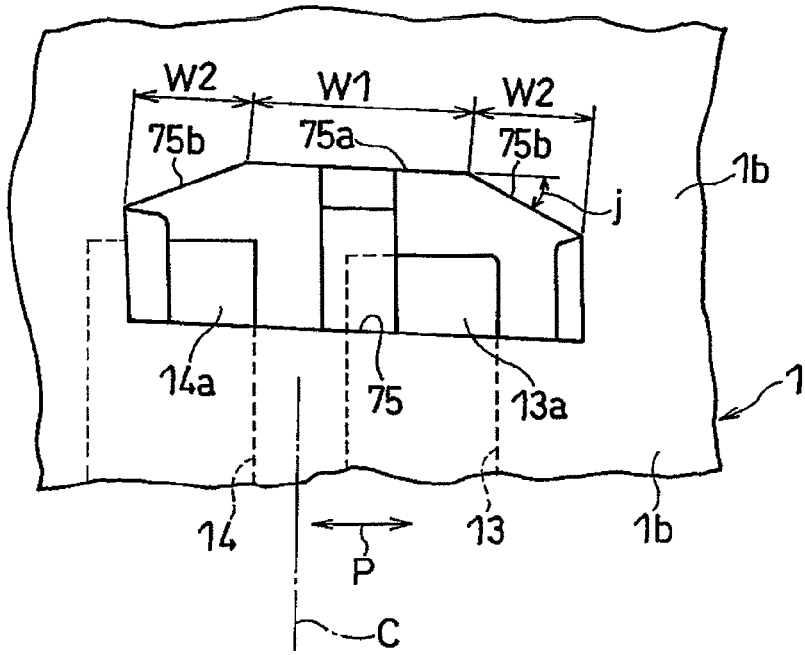
FIG. 14 is a front elevational view showing the scavenging port defined in a portion of an inner periphery of the cylinder block.

Then, as best shown in FIG. 13, the rotary cutting tool 62 having its longitudinal axis K tilted a predetermined angle u relative to the longitudinal axis C of the cylinder bore 1*b* in a rightward direction is moved leftwards to cut a portion of the inner peripheral surface of the cylinder bore 1*b*. In this way, as shown in FIG. 14 showing a front elevational view as viewed radially from the cylinder longitudinal axis C, a leftwardly upwardly oriented open edge 75 of the scavenging ports 13*a* and 14*a* open at the inner peripheral surface of the cylinder block 1 can be formed. This open edge 75 is inclined leftwardly and upwardly as each of the air scavenging ports 14*a* is defined at a level higher than the associated mixture scavenging port 13*a*. In particular, a flat region 75*a* of the open edge 75 at an intermediate portion of an upper edge section thereof is defined by the flat surface 62*a* at the top of the rotary cutting tool 62 as shown in FIG. 10B and inclined regions 75*b* extending downwardly from opposite sides of the flat region 75*a* to associated side edge sections shown in FIG. 14 are defined by the inclined surfaces 62*b* at the top of the rotary cutting tool 62 as shown in FIG. 10B. The vertical dimension of the flat region 75*a* is identical with the vertical dimension of the rotary cutting tool 62 including the flat surface 62*a* thereof as shown in FIG. 10B.

Since the rotary cutting tool 62 shown in FIG. 10B has a top outer periphery formed with the inclined surfaces 62*b*, cutting to define each of the scavenging ports 13*a* and 14*b* that is oriented upwardly towards the cylinder longitudinal axis C can be initiated while the longitudinal axis K of the rotary cutting tool 62 is kept substantially parallel to the cylinder longitudinal axis C as shown in FIG. 9. Accordingly, runout of the rotary cutting tool 62 by the effect of the contact reactive force will occur hardly, resulting in increase of the cutting workability. Since the outer peripheral faces 62*c* of the rotary cutting tool 62 have their height lowered, the contact area with the inner peripheral surface of the cylinder block 1 during the initial stage of cutting is reduced and, therefore, the contact reactive force occurring due to contact of the rotary cutting tool 62 with the inner peripheral surface of the cylinder block 1 shown in FIG. 9 can therefore be reduced. Accordingly, runout of the rotary cutting tool 62 away from the inner peripheral surface of the cylinder block 1 can be minimized and the processing of each of the scavenging ports 13*a* and 14*b* can therefore be facilitated, resulting in increase of the productivity of the cylinder block 1.

Also, since the open edge 75 so formed as shown in FIG. 14 has its upper edge section so shaped as to be complemental to that of the top face of the rotary cutting tool 62 (FIG. 13), that is, as to have its opposite sides inclined downwardly, there is no possibility that the piston ring 73 mounted on the reciprocating piston 7 as shown in FIG. 7 will get stuck on the entire upper edge sections 75*a* and 75*b* of the open edge 75, formed by the regions, and, therefore, the scrabbling force acting on the reciprocating piston 7 through the piston ring 73 is so reduced as to result in reduction in resistance to the piston 7. In addition, since the opening area of each of the scavenging ports 13*a* and 14*b*, shown in FIG. 14, at the initial stage of the scavenging stroke can be reduced, the blow-by of scavenging gas or the air/fuel mixture M into the exhaust passage 12 shown in FIG. 12 can be suppressed.

It is to be noted that the open edge 75 has been shown and described as inclined leftwardly and upwardly on the side of each air scavenging port 14*a* as each of the air scavenging ports 14*a* is defined at a level higher than the associated mixture scavenging port 13*a*. However, where the mixture scavenging ports 13*a* and the air scavenging ports 14*a* are defined at respective positions that are held substantially at the same level, the open edge 75 will extend horizontally without being inclined and, in such case, no process step is required to execute the cutting with the rotary cutting tool 62 inclined as shown in FIG. 13.

In the open edge 75 shown in FIG. 14, the flat region 75*a* at the upper intermediate portion thereof is somewhat inclined relative to a transverse direction P that lies perpendicular to the cylinder longitudinal axis C. Assuming that the width of the flat region 75*a* is expressed by W1 and the width of each of the inclined regions 75*b* in a direction along the flat region 75*a* is expressed by W2, the ratio W2/W1 is chosen to be within the range of 0.3 to 0.8, preferably within the range of 0.35 to 0.7 and more preferably within the range of 0.4 to 0.63. If the ratio W2/W1 is not greater than 0.3, the above described effects cannot be obtained, but if it exceeds 0.8, the opening area of each of the scavenging ports 13*a* and 14*b* will be so excessively small as to result in reduction of the scavenging efficiency.

Also, when the angle of inclination of each of the inclined regions 75*b* relative to the flat region 75*a* is expressed by j, this inclination angle j is chosen to be equal to the inclination angle α of each of the inclined surfaces 62*b* of the rotary cutting tool 62 shown in FIG. 10B and within the range of 5° to 25°, preferably within the range of 10° to 23° and more preferably within the range of 15° to 22°. If the inclination angle j shown in FIG. 14 is not greater than 5°, the previously described effects of the inclined region 75*b* cannot be obtained, but if it exceeds 25°, the opening area of each of the scavenging ports 13*a* and 14*b* will be so excessively small as to result in reduction of the scavenging efficiency.

Figure 15A:
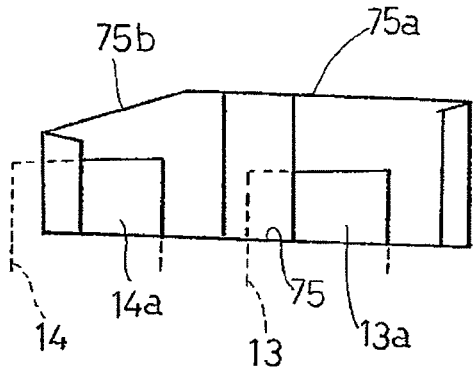
FIGS. 15A and 15B are front views showing different shapes of scavenging ports that may be defined in that portion of the inner periphery of the cylinder block, respectively.
Figure 15B:
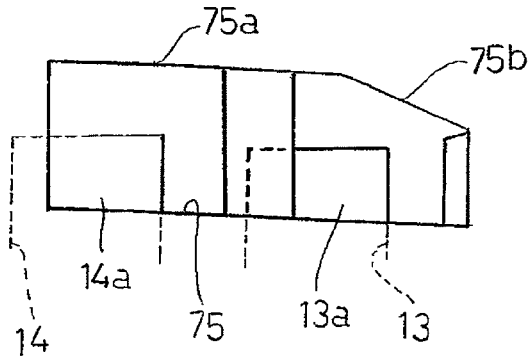

The open edge 75 may be of a shape having the inclined region 75*b* only on, for example, a left side of the flat region 75*a* in the upper edge section thereof as shown in 15A or only on a right side of the flat region 75*a* in the upper edge section thereof as shown in FIG. 15B. Such open edge 75 can be obtained by, after the open edge 75 of the shape as shown in FIG. 14 has been formed, inclining the rotary cutting tool 62 to execute the cutting so as to delete one of the inclined regions 75*b*.

Figure 16:
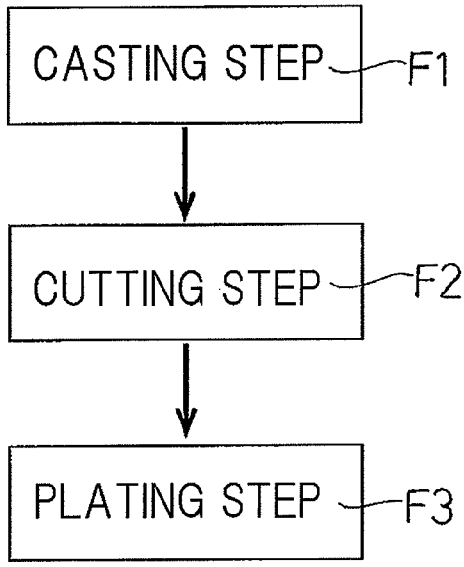
FIG. 16 is a flowchart showing the sequence of formation of the cylinder block.

The sequence of manufacture of the cylinder block 1 according to the present invention will now be described with reference to the flowchart shown in FIG. 16. As shown therein, the cylinder block 1 of the present invention is manufactured by a process including a casting step F1, a cutting step F2 and a plating step F3. In the casting step F1, the molds P1 and P2 are arranged at respective predetermined positions as shown in FIG. 8 and, using a metallic material such as an aluminum alloy, the casting is performed. In this way, the inner mold P1 forms the cylinder bore 1*b* and the scavenging passages 13 and 14. The space between the cylinder bore 1*b* and the scavenging passages 13 and 14 then forms the scavenging passage walls 130 and 140, which form respective parts of the cylinder inner wall.

In the subsequent cutting step F2, as shown in FIG. 9, the rotary cutting tool 62 is inserted into the interior of the cylinder block 1, which is a product die molded after the casting, from bottom of the cylinder block 1 and this rotary cutting tool 62 is then moved in a direction perpendicular to the cylinder longitudinal axis C to cut a predetermined portion of the cylinder block 1 while held in position not to move in a direction conforming to the cylinder longitudinal axis C. By this cutting step F2, the neighboring scavenging ports 13*a* and 14*a* are communicated with each other in a direction circumferentially of the cylinder block 1 and, as a region cut by the rotary cutting tool 62 approaches the cylinder longitudinal axis direction C, the region comes to represent a shape larger than the scavenging passages 13 and 14 in a widthwise direction thereof. By so shaping, the air A and the mixture M, which are a scavenging gas, can be supplied in a large quantity.

In addition, as hereinabove described, the longitudinal axis K of the rotary cutting tool 62 is tilted the predetermined angle u in a rightward direction relative to the cylinder longitudinal axis C and, while it is being moved leftwards, the inner peripheral surface of the cylinder block 1 is cut, as shown in FIG. 13. By so doing, the open edge 75 inclined leftwards, which opens each of the scavenging ports 13*a* and 14*b* at the inner peripheral surface of the cylinder block 1 as shown in FIG. 14, can be formed.

In this cutting step F2, so that cast upper faces 13*d* and 14*d* of the scavenging passages 13 and 14 shown in FIG. 9 as cast and cut upper faces of the scavenging ports 13*a* and 14*a* cut by the rotary cutting tool 62 can be held in flush with each other, or the cut upper faces thereof can be held recessed upwardly relative to the cast upper faces 13*d* and 14*d*, not only is the angle of each of the inclined surfaces 62*b* of the rotary cutting tool 62 set to a preselected value, but the amount of the cylinder block cut by the rotary cutting tool 62 is set to a required value and, by so doing, the flow resistance during the blowing of the scavenging gases is suppressed. By way of example, as far as the setting of the angle of each of the inclined surfaces 62*b* of the rotary cutting tool 62 shown in FIG. 10 is concerned, the angle (90°-α) formed between each inclined surface 62*b* and the cylinder longitudinal axis C (FIG. 9) is so chosen to be equal to or smaller (to make a steep angle) than a value intermediate between the horizontal angle θ1 of the upper face 13*d* of each of the mixture scavenging passages 13 shown in FIG. 6 and the horizontal angle θ2 of the upper face 14*d* of each of the air scavenging passages 14 shown in FIG. 7.

In this way, after the cutting operation to form the scavenging ports 13*a* and 14*a* with the rotary cutting tool 62 shown in FIG. 62 has been done, a cylinder bore finishing, that is, a finishing process to make the inner diameter of the cylinder bore 1*b* uniform over the length thereof in a direction conforming to the cylinder longitudinal axis C is performed. By so doing, burrs formed as a result of cutting to form the scavenging ports 13*a* and 14*a* can be removed. Thereafter, the cylinder block 1 is plated during the plating step F3 shown in FIG. 16.

Figure 17:
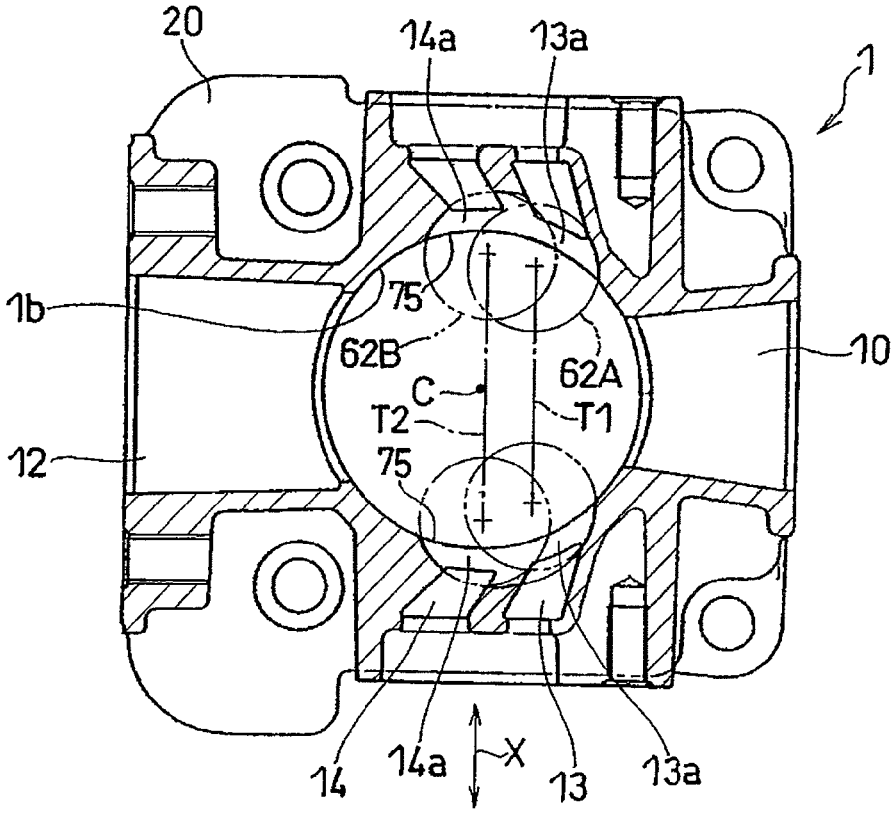
FIG. 17 is a transverse sectional view showing the cylinder block according to a second preferred embodiment of the present invention.
Figure 18:
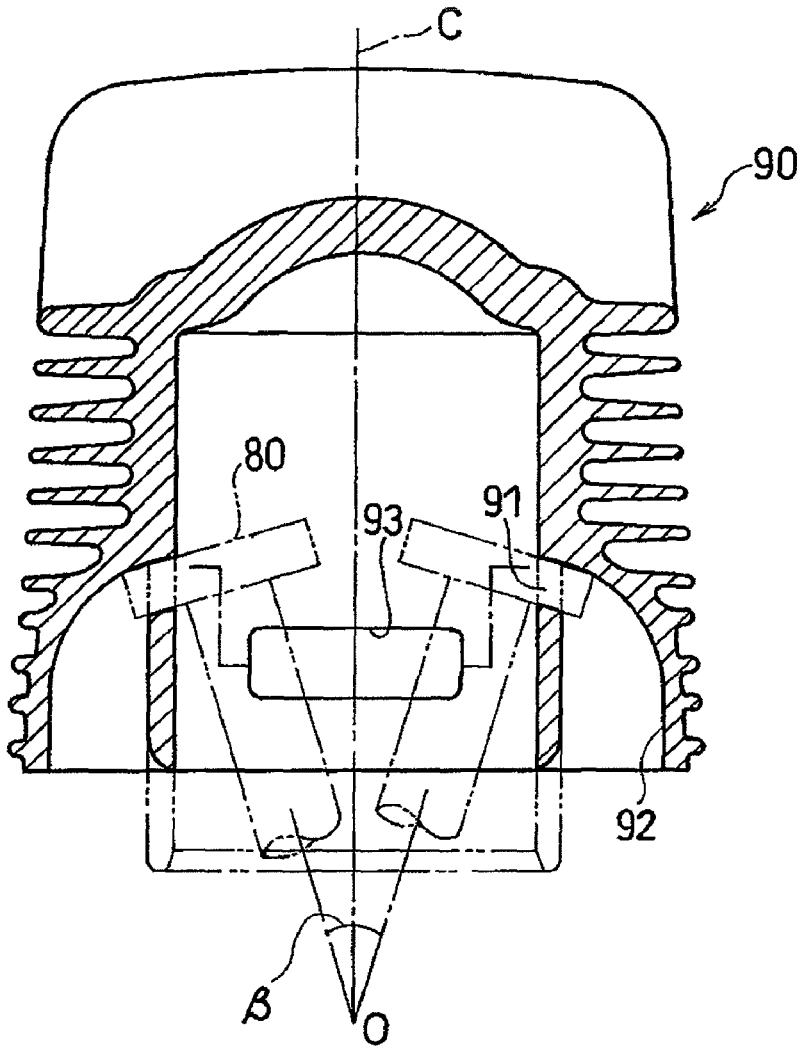
FIG. 18 is a longitudinal sectional view of the cylinder block, showing the prior art method of forming the scavenging ports.
Figure 19:
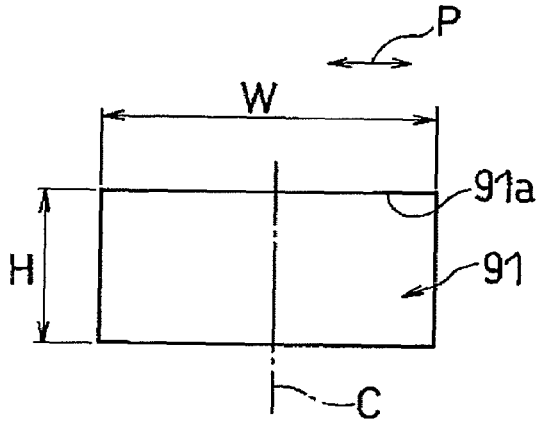
FIG. 19 is a front elevational view showing one of the scavenging ports defined according to the prior art method.

FIG. 17 illustrates a transverse sectional view of the cylinder block according to a second preferred embodiment of the present invention. In this embodiment, two types of cutters, that is, first and second rotary cutting tools 62A and 62B are employed. The first rotary cutting tool 62A has the inclination angle α (FIG. 10), which is 18°, and the second rotary cutting tool 62B has the inclination angle α (FIG. 10), which is 10°. By moving the first rotary cutting tool 62A, then rotated, forwards and rearwards along a path T1, each of the mixture scavenging ports 13*a* having the horizontal angle of 72° is formed by cutting. Thereafter, by moving the second rotary cutting tool 62B, then rotated, forwards and rearwards along a path T2, each of the air scavenging ports 14*a* having the horizontal angle of 80° is formed by cutting.

It is to be noted that although the two-cycle combustion engine according to any one of the foregoing embodiments has been shown and described as including not only the mixture scavenging passages 13, but also the air scavenging passages 14, the present invention can be equally applied to the two-cycle combustion engine including only the mixture scavenging passages 13 with the air scavenging passages 14 dispensed with. In addition, the present invention can be equally applicable to any type of two-cycle combustion engine, in which the combustion chamber 1*a* and a passage for transmitting a variation in pressure inside the crankcase 2 for creating a force necessary to guide a scavenging gas to the combustion chamber 1*a* are partitioned by an inner peripheral wall (corresponding to the scavenging passage walls in the foregoing embodiment) of the cylinder block 1 and a scavenging port, through which the scavenging gas can be introduced into the combustion chamber 1*a*, is formed in the inner peripheral surface of the cylinder block 1.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. In a cylinder block for a two-cycle combustion engine including a scavenging port, open at an inner peripheral surface of the cylinder block, and orient diagonally upwardly relative to a longitudinal axis of a cylinder bore and defined in the cylinder lock in communication with a combustion chamber, the improvement comprising: an air scavenging passage in the cylinder block; a fuel mixture scavenging passage in the cylinder block, wherein the air scavenging passage extends further upward from the fuel mixture scavenging passage in the cylinder block, wherein the air scavenging passage and the fuel mixture scavenging passage communicate with the scavenging port adjacent the inner peripheral surface of the cylinder block; and the scavenging port has an open perimeter edge formed on the inner peripheral surface of the cylinder bore including an upper edge section which includes a flat region at an intermediate portion of the upper edge section and respective inclined regions extending diagonally downwardly from opposite sides of the flat region to associated side perimeter edge sections of the scavenging port.

2. The cylinder block for the two-cycle combustion engine as claimed in claim 1, wherein the inclined region has a width as measured in a direction conforming to the flat region, which is 0.3 to 0.8 times the width of the flat region.

3. The cylinder block for the two-cycle combustion engine as claimed in claim 1, wherein the inclined region is inclined at an angle within the range of 5° to 25° relative to the flat region.

4. A method for manufacturing a cylinder block for a two-cycle combustion engine as defined in claim 1, including the step of cutting the upper edge section to have an inclined surface in the cylinder block extending radially outwardly and downwardly along the upper edge section of the cylinder bore from the flat region at an intermediate portion to form the upper edge of the scavenging port by cutting the cylinder block from radially inwardly of the cylinder bore to radially outwardly thereof.

* * * * *